US005991241A

United States Patent [19]

Hsu

[11] Patent Number: 5,991,241

[45] Date of Patent: Nov. 23, 1999

[54] TIMEPIECE WITH AN ALARM TIME-SETTING FUNCTION

[75] Inventor: Mu-Sheng Hsu, Taipei, Taiwan

[73] Assignee: Young Town Enterprises Co., Ltd., Taiwan

[21] Appl. No.: 09/293,820

[22] Filed: Apr. 16, 1999

[51] Int. Cl.[6] ..... G04B 23/02

[52] U.S. Cl. ..... 368/74; 368/250

[58] Field of Search ..... 368/72–74, 250, 368/185–197

[56] References Cited

U.S. PATENT DOCUMENTS 4,996,676 2/1991 Noirjean ..... 368/73
5,003,519 3/1991 Noirjean ..... 368/73
5,541,895 7/1996 Nussbaum ..... 368/295

*Primary Examiner*—Vit Miska
*Attorney, Agent, or Firm*—Webb Ziesenheim Logsdon Orkin & Hanson, P.C.

[57] ABSTRACT

A wristwatch with an alarm time-setting function includes a clock case having a hollow accommodating space, a clock mechanism mounted in the accommodating space, and a rotary drive ring mounted rotatably on the front side of the clock case. The wristwatch further includes a timer-setting member accommodated inside the accommodating space and connected to a timer-setting pin of the clock mechanism. A driving member of the rotary drive ring is disposed inside the accommodating space to engage a driven part of the timer-setting member. Thus, rotation of the rotary drive ring results in corresponding rotation of the timer-setting member and the timer-setting pin to set an alarm time.

19 Claims, 3 Drawing Sheets

TIMEPIECE WITH AN ALARM TIME-SETTING FUNCTION

BACKGROUND OF THE INVENTION

1. Field of the Invention

The present invention relates to a timepiece, more particularly to a wristwatch with an alarm time-setting function.

2. Description of the Related Art

Alarm timepieces, especially alarm clocks, are well known and prevalent in the market. The alarm clocks, when in use, are placed on certain places, unlike a wristwatch which is worn around the user's wrist. Therefore, the arrangement of a rotary pin or plate, which is connected to a timer-setting unit inside the clock case and which is accessible to the user for time-setting purpose, has few restrictions when applied to the alarm clock. Particularly, a conventional rotary pin or plate provided on the alarm clock for time-setting purposes is mostly disposed on a back cover of the alarm clock. Such an arrangement, however, is not applicable to a wristwatch. A wristwatch with a rotary pin or plate on the back cover thereof can cause a great deal of inconvenience when an alarm time-setting operation is performed. This is due to the need to remove the wristwatch from the user's wrist so as to carry out the alarm time-setting operation. Moreover, with the rotary pin or plate disposed on the back cover of the wristwatch, the wristwatch fails to provide a smooth surface for contacting the user's wrist, thus causing discomfort to the user. Accordingly, the conventional design that the rotary pin or plate is disposed on the back cover of the alarm clock is not applicable to a wristwatch with an alarm capability.

SUMMARY OF THE INVENTION

Therefore, the object of the present invention is to provide a timepiece, such as a wristwatch, with an alarm time-setting function. Since the alarm time-setting operation can be carried out on a front side of the wristwatch, removal of the wristwatch for time setting is unnecessary. Further, since the wristwatch does not have a rotary pin or rotary plate projecting from the back cover thereof, the wristwatch does not cause discomfort to the user.

Accordingly, the timepiece of this invention includes: a clock case having a front side, a rear side, and a hollow accommodating space that extends from the front side toward the rear side; a clock mechanism mounted in the accommodating space adjacent to the rear side of the clock case, the clock mechanism having a front surface and a timer-setting pin that extends forwardly from the front surface; a timer-setting member disposed inside the accommodating space of the clock case adjacent to the front surface of the clock mechanism, the timer-setting member having a driven part and a mounting part for connecting securely the timer-setting member to the timer-setting pin; and a rotary drive ring mounted rotatably on the front side of the clock case, the rotary drive ring having a rear portion that extends rearwardly into the accommodating space and that is formed with a driving member for engaging securely the driven part of the timer-setting member; rotation of the rotary drive ring resulting in corresponding rotation of the timer-setting member due to engagement between the driving member of the rotary drive ring and the driven part of the timer-setting member, and further resulting in corresponding rotation of the timer-setting pin to set an alarm time for the timepiece.

BRIEF DESCRIPTION OF THE DRAWINGS

The features and advantages of the present invention will be described in more detail with reference to the accompanying drawings which illustrate the preferred embodiment of this invention, wherein.

DETAILED DESCRIPTION OF THE PREFERRED EMBODIMENT

Figure 1:
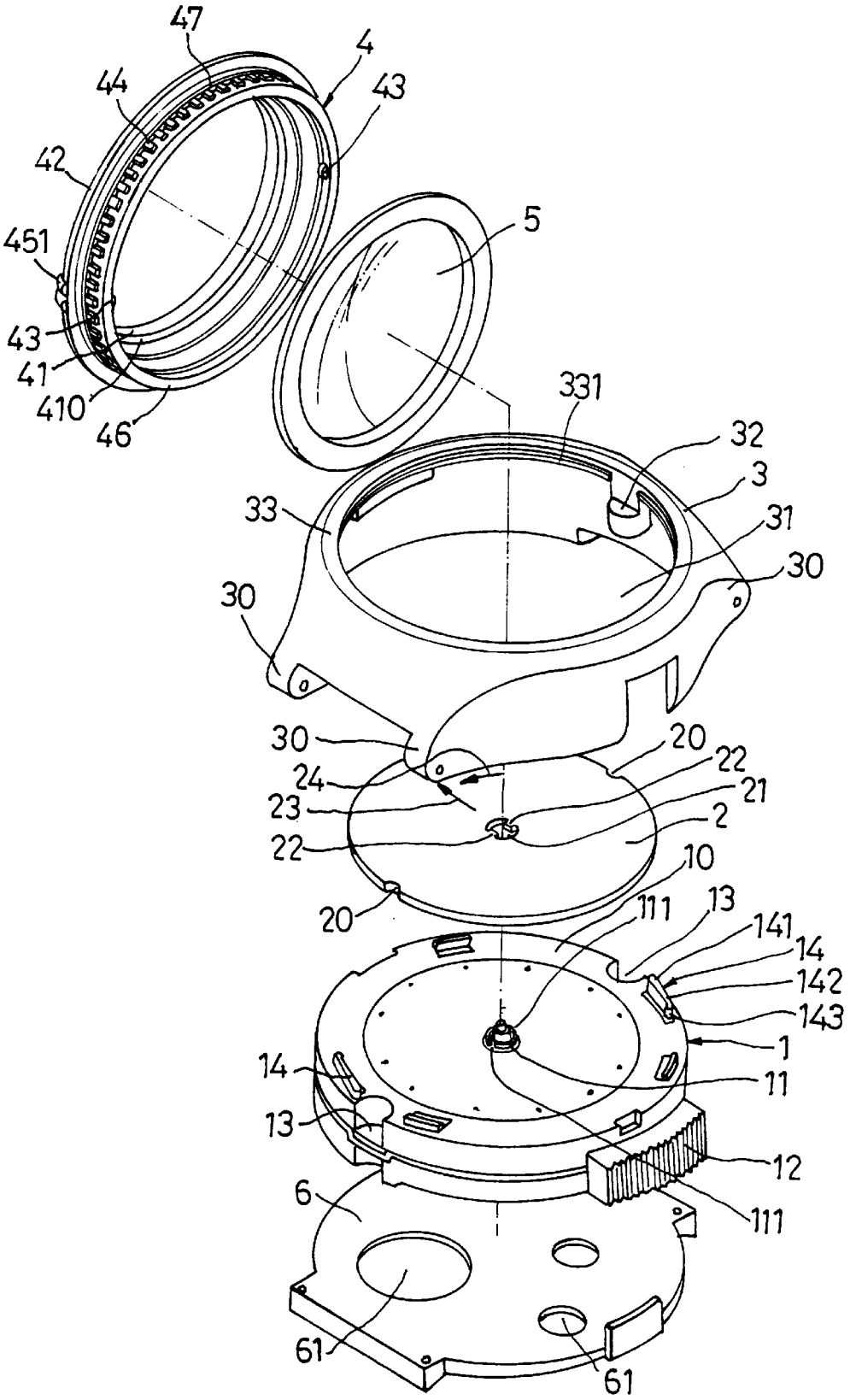
FIG. 1 is an exploded perspective view of the preferred embodiment of a timepiece according to this invention.
Figure 2:
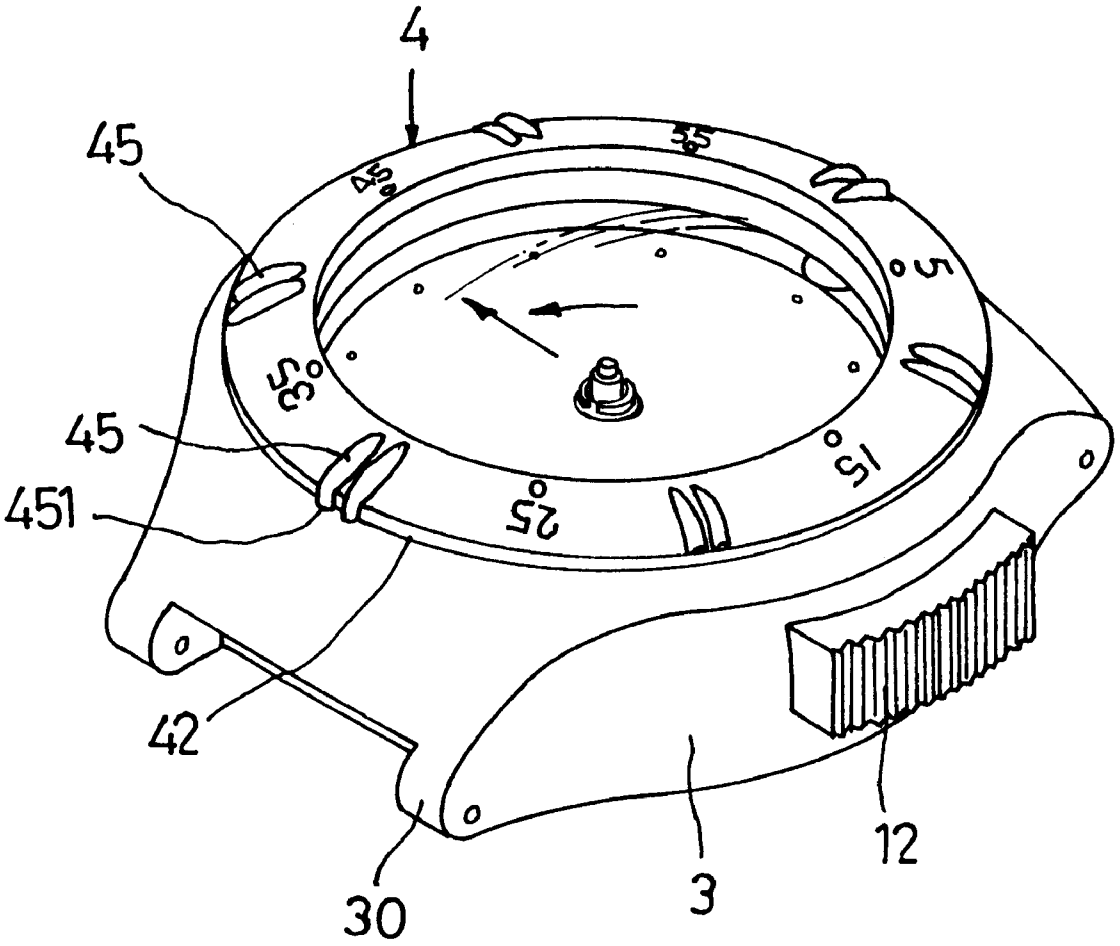
FIG. 2 is an assembled view of the preferred embodiment.

Referring to FIGS. 1 and 2, the preferred embodiment of a timepiece according to this invention is shown to be in the form of a wristwatch that includes a clock mechanism 1 having a front surface 10, a clock case 3 having a hollow accommodating space 31, a timer-setting member 2 received inside the accommodating space 31, and a rotary drive ring 4 mounted rotatably on the front side of the clock case 3. The clock mechanism 1 is mounted in the accommodating space 31 adjacent to the rear side of the clock case 3.

The clock mechanism 1 is provided with a timer-setting pin 11, an hour hand driving pin, a minute hand driving pin, and a second hand driving pin, which extend forwardly from the front surface 10 of the clock mechanism 1 and which are arranged coaxially at the center of the front surface 10. The hour hand driving pin, the minute hand driving pin, and the second hand driving pin are used to drive an hour hand, a minute hand, and a second hand, respectively. The hands are driven rotatably by the clock mechanism 1 in a conventional manner. Since the operation of the driving pins which drive the hands are irrelevant to this invention, the hand driving pins and the hands are not shown in the drawings for the sake of clarity. Further, since the mechanism for driving the hand driving pins, as well as the mechanism for actuating an alarm provided inside the clock mechanism 1 to sound at a predetermined time are known in the art and are irrelevant to this invention, a description thereof will be omitted herein.

A movable block 12 is attached on the peripheral wall of the clock mechanism 1. The movable block 12 is connected to a switch (not shown in the drawings) inside the clock mechanism 1 and is movable along the circumference of the clock mechanism 1 between a turn-on position where an alarm inside the clock mechanism 1 is free to sound at a predetermined time that is set, and a turn-off position where the alarm cannot be actuated to sound at the predetermined time. When the movable block 12 is moved to the turn-off position during sounding of the alarm, the switch inside the clock mechanism 1 will turn off the alarm. Since the mechanism for alarming is irrelevant to the feature of this invention, a detailed description thereof will also be omitted herein.

The front surface 10 of the clock mechanism 1 has a peripheral portion, where a pair of positioning slots 13 are formed. The positioning slots 13 are of predetermined depth along the direction of thickness of the clock mechanism 1. Further, a pair of leaf springs 14 are provided on the peripheral portion of the front surface 10 and are spaced apart diametrically. Each of the leaf springs 14 has a mounting end 141 mounted securely on the front surface 10 of the clock mechanism 1, and a body portion 142 extending from the mounting end 141 and projecting forwardly from the front surface 10 of the clock mechanism 1. The body portion 142 of each of the leaf springs 14 is bendable resiliently when a force is applied. The body portion 142 of each of the leaf springs 14 has a distal end 143 which projects radially and inwardly from a lateral side of the body portion 142.

The timer-setting pin 11 is coaxial with a central axis of the clock case 3 and has two opposing recesses 111 formed on the periphery thereof for mounting the timer-setting member 2 adjacent to the front surface 10 of the clock mechanism 1. The timer-setting member 2, which is a transparent plate in the preferred embodiment, has a mounting part for mounting securely the same on the timer-setting pin 11 of the clock mechanism 1. The mounting part is a mounting hole 21 formed centrally of the timer-setting member 2. Two tabs 22 extend opposingly from the periphery of the mounting hole 21 for engaging securely the respective one of the recesses 111 formed on the periphery of the timer-setting pin 11. The timer-setting member 2 has a pair of notches 20 formed on the periphery thereof and spaced apart diametrically. The timer-setting member 2 is further provided with a time indicator 23 and a direction indicator 24. The time indicator 23 is a straight arrow with an arrowhead directed radially and outwardly, for indicating the time that is set. The direction indicator 24 is a curved arrow extending circumferentially, with an arrow head directed to the proper rotational direction, for example, counterclockwise in FIG. 1, of the timer-setting member 2 when conducting the time-setting operation.

As previously stated, the timer-setting plate 2 is mounted securely on the timer-setting pin 11 with the tabs 22 engaging fittingly the recesses 111 such that timer-setting plate 2 can rotate along with the timer-setting pin 11, which in turn, drives a timer (not shown in the drawings) inside the clock mechanism 1.

The clock case 3, which forms a hollow accommodating space 31 along its central axis, is provided with a pair of pivot seats 30. The pivot seats 30 are provided diametrically on the outer portion of the clock case 3 for mounting opposing ends of a conventional watchband (not shown in the drawings). The accommodating space 31 of the clock case 3 receives the clock mechanism 1 therein adjacent to the rear side of the clock case 3. Two positioning projections 32 are provided on the inner peripheral wall of the clock case 3 and inside the accommodating space 31, and are suitably shaped to be inserted fittingly into the corresponding positioning slots 13 formed on the peripheral portion of the front surface 10 of the clock mechanism 1.

The front end of the clock case 3 is formed with an annular flange 33 which extends radially into the accommodating space 31 from the inner peripheral wall of the clock case 3. The inside diameter of the annular flange 33 is slightly smaller than that of the clock mechanism 1. An annular engaging groove 331 is provided inside the accommodating space 31 and on the inner peripheral wall of the clock case 3, adjacent to the annular flange 33.

Figure 3:
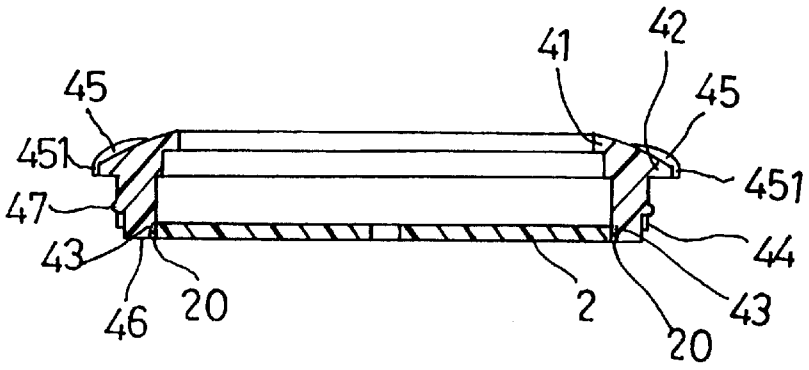
FIG. 3 is a cross-sectional view showing the engagement between a rotary drive ring and a timer-setting member.

The rotary drive ring 4 is mounted rotatably on the front side of the clock case 3, and has a front portion extending outwardly of the accommodating space 31 of the clock case 3, and a rear portion extending rearwardly into the accommodating space 31. As clearly shown in FIG. 3, the rotary drive ring 4 is formed with an annular inward shoulder 41 extending from the inside peripheral wall thereof, and an annular outward shoulder 42 extending from the outside peripheral wall thereof. The annular inward shoulder 41 is disposed in front of the annular outward shoulder 42. The annular outward shoulder 42 rests slidably on the annular flange 33 of the clock case 3.

As a transparent cover 5 is assembled into the rotary drive ring 4, the outside periphery of the transparent cover 5 engages fittingly the inside periphery of the rotary drive ring 4. Also, the transparent cover 5 abuts against the rear surface 410 of the annular inward shoulder 41, such that the transparent cover 5 is prevented from dropping out from the rotary drive ring 4.

The rear portion of the rotary drive ring 4 has a pair of driving members 43 and an annular series of notches 44. The driving members 43 are provided on the inside peripheral wall of the rotary drive ring 4 and are spaced apart diametrically. The driving members 43 engage fittingly the corresponding one of the notches 20 formed on the periphery of the timer-setting member 2. With the engagement between the driving members 43 and the notches 20, the timer-setting member 2 rotates concurrently with the rotary drive ring 4.

The front portion of the rotary drive ring 4 is formed with a radial inward flange 47 which is located in front of the annular series of notches 44. When the rotary drive ring 4 is assembled into the clock case 3 from the front side of the clock case 3, the radial inward flange 47 of the rotary drive ring 4 is forcibly pressed into the annular groove 331 formed on the inner peripheral wall of the clock case 3, such that the front portion of the rotary drive ring 4 is mounted rotatably on the front side of the clock case 3 and such that the rotary drive ring 4 is prevented from disengaging therefrom.

Further, the rotary drive ring 4 has a rear end surface 46 abutting against the front surface 10 of the clock mechanism 1, such that the timer-setting member 2 is received inside the space defined by the rotary drive ring 4.

Figure 4:
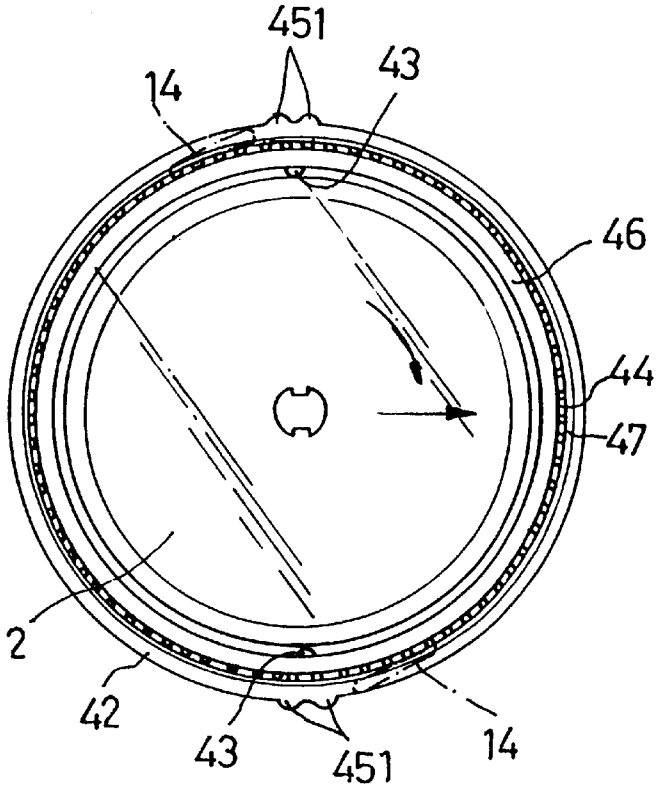
FIG. 4 is a top plan view of the preferred embodiment.

When the rotary drive ring 4 is mounted rotatably on the clock case 3, the driving members 43, which extend from the rear portion of the rotary drive ring 4, engage fittingly the notches 20 formed on the periphery of the timer-setting member 2. Also, the distal ends 143 of the leaf springs 14 resiliently engage the annular series of notches 44 so as to provide rotational resistance to the rotary drive ring 4. The operation of the leaf springs 14 is clearly shown in FIG. 4, wherein the leaf springs 14 are illustrated using imaginary lines. The distal ends 143 of the leaf springs 14 engage releasably the annular series of notches 44 when the rotary drive ring 4 is rotated, thereby allowing stepwise rotation of the rotary drive ring 4 relative to the clock mechanism 1.

To facilitate the manipulation of the rotary drive ring 4, the front portion of the rotary drive ring 4 is provided with bosses 45 on the front end surface 40 thereof. Two bosses 45, which are arranged opposingly on the front end surface 40 of the rotary drive ring 4, have an outer portion 451 which slightly extends over the annular outward shoulder 42. The two bosses 45 are aligned with the respective one of the driving members 43 disposed on the rear portion of the rotary drive ring 4 to indicate the positions of the driving members 43 and facilitate the positioning of the driving members 43 into the corresponding one of the notches 20.

A back cover 6 is securely mounted onto the rear side of the assembly of the clock mechanism 1 and the clock case 2, so as to serve as a support for the clock mechanism 1. The back cover 6 has a smooth surface that fits the user's wrist. The back cover 6 has a plurality of openings 61 for installing batteries and for accessing the interior of the clock mechanism 1.

With the above-mentioned construction, the alarm time-setting operation is performed from the front side of the wristwatch. By rotating the rotary drive ring 4, the timer-setting member 2 is driven to rotate correspondingly due to engagement between the driving members 43 of the rotary drive ring 4 and the notches 20 of the timer-setting member 2. Since the timer-setting member 2 is securely mounted on the timer-setting pin 11, the rotation of the timer-setting member 2 results in corresponding rotation of the timer-setting pin 11 to set an alarm time for the wristwatch. The time that is set is indicated by the time indicator 23 on the timer-setting member 2.

With the use of the wristwatch of this invention, the wristwatch need not be removed from the user's wrist to conduct the alarm time-setting operation, thereby arising in no inconvenience. It is possible for the wristwatch to have a smooth cover which contacts suitably the user's wrist so that the wristwatch will not cause any discomfort to the user.

It should be understood that the above description is intended to be illustrative and not restrictive. A variety of modifications will be apparent to those skilled in the art within the sprit and scope of the invention as defined in the appended claims.

I claim:

1. A timepiece with an alarm time-setting function, comprising:

a clock case having a front side, a rear side, and a hollow accommodating space that extends from said front side toward said rear side;

a clock mechanism mounted in said accommodating space adjacent to said rear side of said clock case, said clock mechanism having a front surface and a timer-setting pin that extends forwardly from said front surface;

a timer-setting member disposed inside said accommodating space of said clock case adjacent to said front surface of said clock mechanism, said timer-setting member having a driven part and a mounting part for connecting securely said timer-setting member to said timer-setting pin; and a rotary drive ring mounted rotatably on said front side of said clock case, said rotary drive ring having a rear portion that extends rearwardly into said accommodating space and that is formed with a driving member for engaging securely said driven part of said timer-setting member;

rotation of said rotary drive ring resulting in corresponding rotation of said timer-setting member due to engagement between said driving member of said rotary drive ring and said driven part of said timer-setting member, and further resulting in corresponding rotation of said timer-setting pin to set an alarm time for said timepiece.

2. The timepiece as claimed in claim 1, wherein said clock mechanism further has a first engaging unit on said front surface, and said rotary drive ring further has a second engaging unit at said rear portion adjacent to said clock mechanism, said first and second engaging units releaseably engaging each other to allow stepwise rotation of said rotary drive ring relative to said clock mechanism.

3. The timepiece as claimed in claim 2, wherein said first engaging unit is a leaf spring, and said second engaging unit is an annular series of notches, said leaf spring having a mounting end secured on said front surface of said clock mechanism, and a distal end that engages releasably said notches when said rotary drive ring is rotated.

4. The timepiece as claimed in claim 1, wherein said rotary drive ring has a front portion that extends outwardly of said accommodating space of said clock case.

5. The timepiece as claimed in claim 4, wherein said front portion of said rotary drive ring has a front end surface provided with at least one boss to facilitate manipulation of said rotary drive ring.

6. The timepiece as claimed in claim 4, wherein said front portion of said rotary drive ring has a front end surface provided with a boss that is aligned with said driven part of said timer-setting member.

7. The timepiece as claimed in claim 4, wherein said clock case is formed with an annular groove in said accommodating space adjacent to said front side, said front portion of said rotary drive ring being formed with a radial inward flange to engage said annular groove and retain rotatably said front portion of said rotary drive ring on said front side of said clock case.

8. The timepiece as claimed in claim 1, further comprising locking means for locking said clock mechanism onto said clock case.

9. The timepiece as claimed in claim 8, wherein said locking means comprises a projection on one of said clock case and said clock mechanism, and a slot in the other one of said clock case and said clock mechanism to engage said projection fittingly.

10. The timepiece as claimed in claim 1, wherein said timer-setting member is further provided with an indicator for indicating time-setting direction and the alarm time that is set.

11. The timepiece as claimed in claim 4, further comprising a transparent cover having an outside periphery, said front portion of said rotary drive ring having an inside periphery that engages fittingly said outside periphery of said transparent cover.

12. The timepiece as claimed in claim 1, wherein said timer-setting member is a transparent plate, said driven part being disposed on a peripheral portion of said timer-setting member.

13. The timepiece as claimed in claim 12, wherein said one of said driven part and said rear portion of said rotary drive ring is provided with a projection, and the other one of said driven part and said rear portion of said rotary drive ring is provided with a slot to engage said projection.

14. The timepiece as claimed in claim 12, wherein said accommodating space of said clock case has a central axis, said timer-setting pin extending coaxially with said central axis.

15. The timepiece as claimed in claim 14, wherein said mounting part of said timer-setting member is formed with a mounting hole for engaging securely said timer-setting pin to permit co-rotation of said timer-setting pin with said timer-setting member.

16. The timepiece as claimed in claim 1, further comprising a rear cover mounted on said rear side of said clock case to cover said accommodating space.

17. The timepiece as claimed in claim 1, wherein said clock case is a watch case.

18. The timepiece as claimed in claim 1, wherein said clock case is a wristwatch case.

19. The timepiece as claimed in claim 4, wherein said front portion of said rotary drive ring has a radially and outwardly extending annular flange seated slidably and rotatably on said front side of said clock case.

* * * * *